US010260848B2

(12) United States Patent
Utille

(10) Patent No.: US 10,260,848 B2
(45) Date of Patent: Apr. 16, 2019

(54) TO A TRAINING ARROW TIP FOR A TARGET

(71) Applicant: Lionel Utille, Faverges (FR)

(72) Inventor: Lionel Utille, Faverges (FR)

( * ) Notice: Subject to any disclaimer, the term of this patent is extended or adjusted under 35 U.S.C. 154(b) by 0 days.

(21) Appl. No.: 15/542,297

(22) PCT Filed: Jan. 7, 2016

(86) PCT No.: PCT/FR2016/050022
§ 371 (c)(1),
(2) Date: Jul. 7, 2017

(87) PCT Pub. No.: WO2016/110652
PCT Pub. Date: Jul. 14, 2016

(65) Prior Publication Data

US 2018/0266795 A1 Sep. 20, 2018

(30) Foreign Application Priority Data

Jan. 8, 2015 (FR) ..... 15 50145

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 3,618,948 A * | 11/1971 | McGlocklin | ..... | F42B 6/08 30/319 |
| 4,203,601 A | 5/1980 | Simo | | |
| 5,114,156 A * | 5/1992 | Saunders | ..... | F42B 6/08 473/582 |
| 8,057,331 B2 * | 11/2011 | Hudkins | ..... | F42B 6/08 473/583 |
| 8,113,973 B1 * | 2/2012 | Lee | ..... | F42B 6/08 473/583 |

FOREIGN PATENT DOCUMENTS

| | | |
|---|---|---|
| DE | 203 16 672 | 1/2014 |
| FR | 1 055 142 | 2/1954 |
| FR | 2 961 896 | 12/2011 |

* cited by examiner

*Primary Examiner* — John Ricci
(74) *Attorney, Agent, or Firm* — Greenblum & Bernstein, P.L.C.

(57) ABSTRACT

Arrowhead (1) for a target, comprised of an arrowhead body (2) having three portions, including a front portion (2*a*), a central portion (2*b*), and a rear portion (2*c*), the front portion constituting the point for penetrating into the target, comprising mechanisms for facilitating the removal of the lodged arrow, such mechanisms being formed by at least one projecting profile (3), characterized in that the projecting profile(s) is/are in the form of a portion of a sphere.

19 Claims, 4 Drawing Sheets

TO A TRAINING ARROW TIP FOR A TARGET

The present invention relates to a bow or crossbow arrowhead facilitating the removal of an arrow lodged in a target, irrespective of the target-forming material.

During practice and competition, users are faced with the problem of removing the arrow lodged in the target. Indeed, the effort required to retrieve the arrow is substantial, so that it is difficult, even almost impossible, for a single person to extract the arrow from the target without tools.

To this end, certain devices are provided as tools for facilitating the extraction of the arrow from the target. Most of these devices are comprised of a member acting as a lever, making it possible to reduce the extraction effort.

Also disclosed in the patent FR 1055142 is a device for facilitating the removal of an arrow from a target, comprised of a ring made of a deformable material adapted to be compressed and to space the target-forming material apart, around the arrowhead body, in order to facilitate its removal. This device does not perform with maximum effectiveness, and the arrow gets stuck in the target, as the ring of deformable material does not always reassume its shape and original position. Thus, a deformable material of this type ages more or less rapidly, especially as the friction exerted by the arrowhead penetrating into a target is significant.

The invention provides arrowheads comprising a device for facilitating its extraction from the target without tools.

The arrowhead of the invention is comprised of an arrowhead body having three portions, including a front portion, a central portion and a rear portion, the front portion constituting the point for penetrating into the target. The central portion comprises mechanisms on its outer periphery for facilitating the extraction of the arrow lodged in a target or the like. The extraction-facilitating mechanisms are formed by at least one projecting profile made of a non-deformable material and located on the outer surface of the central portion of the arrowhead body, and fixed in translation along its longitudinal axis.

The projecting profile(s) only partially cover(s) the outer periphery of the arrowhead body and is/are in the form of a portion of a sphere and has/have a thickness of less than 5.0 mm.

According to the invention, the projecting profile(s) is/are arranged on a portion of the periphery of the arrowhead body.

According to a plurality of alternative embodiments of the invention, the projecting profile(s) is/are a component of the central portion of the body and is/are integral with the arrowhead body or is/are formed by at least one bearing ball.

In the case of the bearing balls(s), the latter is/are arranged in at least one groove forming at least one hollow profile and comprises at least a portion projecting beyond the outer peripheral surface of the arrowhead body.

According to another characteristic of the invention, the projecting profile(s) only partially cover(s) the peripheral surface of the arrowhead body According to another alternative embodiment, the projection(s) is/are constituted by at least one opening formed on the arrowhead body, opening out to the outside of the peripheral surface of the arrowhead body in which at least one bearing ball is housed, advantageously free in rotation.

According to yet another possible embodiment, the projection(s) is/are made on at least one element forming a ring adapted to be inserted between the separable portions of the arrowhead body.

Other characteristics and advantages of the invention will become apparent from the following description, with reference to the annexed drawings which are only given by way of non-limiting examples, in which:

FIGS. 1*a*, 1*b*, 1*c* show a perspective view of the arrowhead of the invention according to the second, third and first embodiments, respectively, of the arrowhead;

FIG. 2 shows a cross-sectional view of the arrow and arrowhead penetrating a target, according to the second embodiment.

FIGS. 3*a* and 3*b* show a cross-sectional view of the arrowhead body according to the second embodiment, with the bearing balls and without the bearing balls, respectively.

Figure 1A:
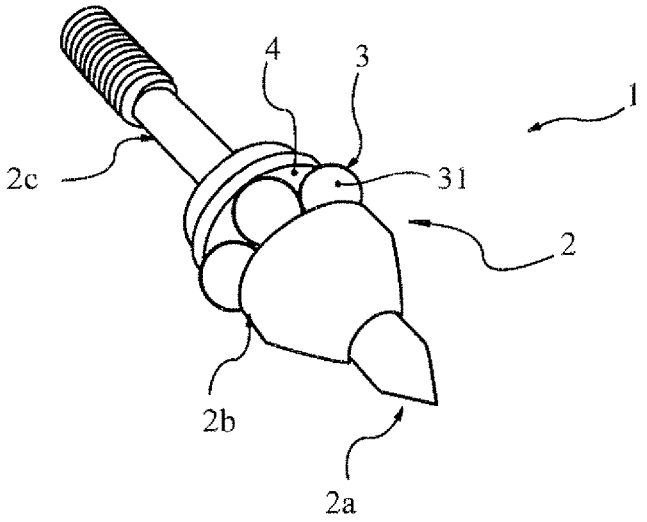

The arrowhead (1) of the invention is comprised of an arrowhead body (2) having a front end portion (2*a*), a central portion (2*b*), and a rear end portion (2*c*). The rear end portion (2*c*) comprises mechanisms for fastening the arrow (100), and the front end portion (2*a*) comprises penetrating mechanisms advantageously formed by at least a section having a pointed profile, the central portion (2*b*) being located between the end portions (2*a*, 2*c*), According to the invention, the arrowhead (1) comprises mechanisms on its outer periphery for facilitating the extraction of the arrow (100) lodged in a target (101).

These mechanisms facilitating the extraction of the arrow are made by at least one profile (3) projecting from the outer surface of the central portion (2*b*) of the arrowhead body. The projection(s) is/are fixed in translation on the arrowhead body and stationary along the longitudinal axis (X) of the body. According to the invention, the projecting profile(s) (3) only partially cover(s) the outer periphery of the central portion (2*b*) of the arrowhead body. In other words, the central portion of the arrowhead comprises a peripheral succession of projections.

According to the preferred embodiment of the invention, the projecting profile(s) (3) is/are in the form of a portion of a sphere. According to other embodiments, the profile(s) (3) has/have an oblong, parallelepipedic, conical, pyramidal shape, and any free forms.

The profile(s) (3) has/have a thickness less than 5 mm, projecting from the outer peripheral surface of the arrowhead body.

According to one characteristic of the invention, the projecting profile(s) only partially cover(s) the peripheral surface of the central portion (2*b*) of the arrowhead body.

Figure 1B:
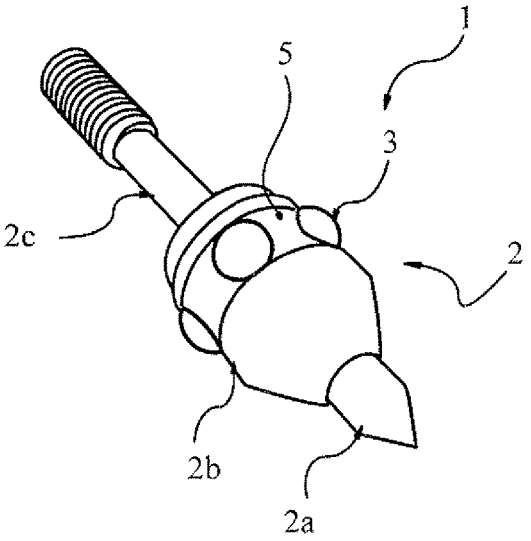
Figure 1C:
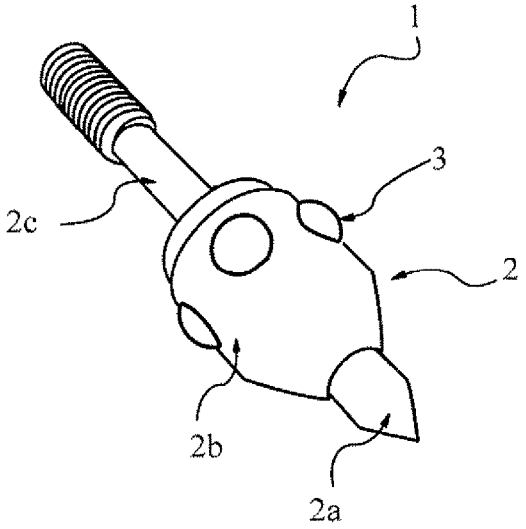
Figure 2:
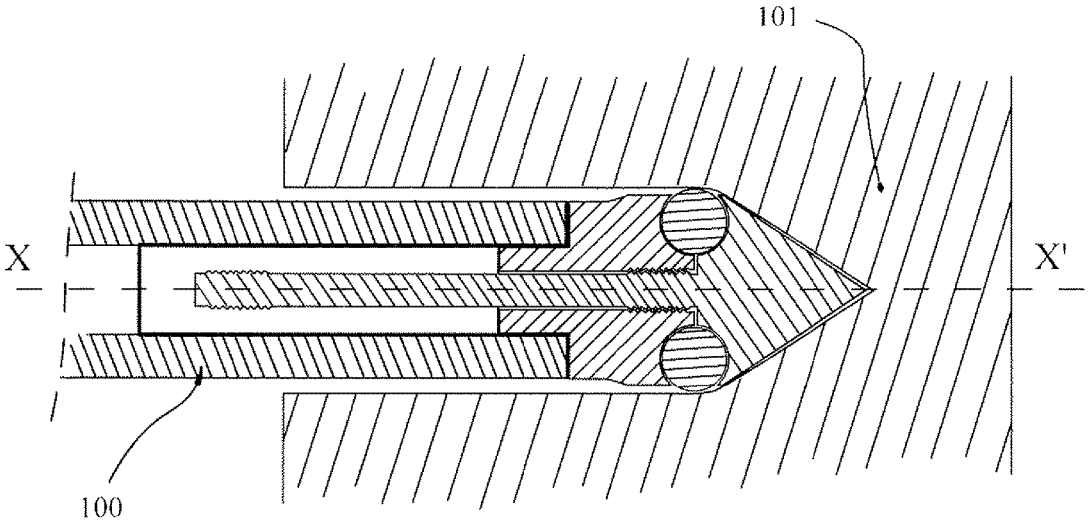
Figure 3A:
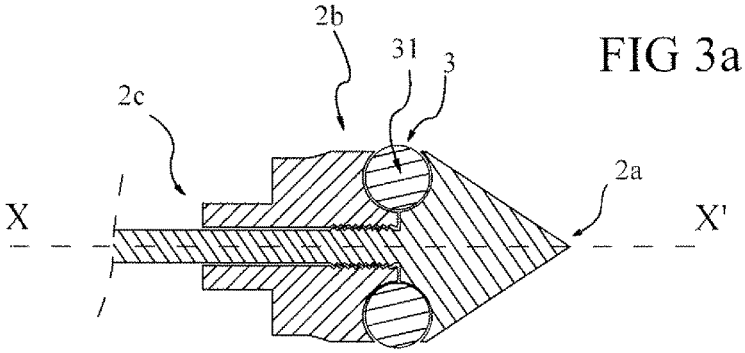
Figure 3B:
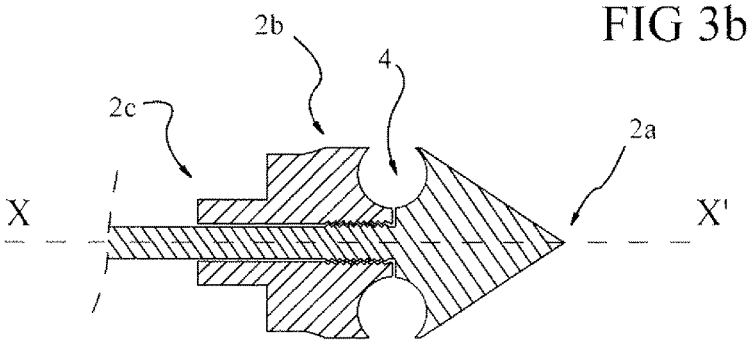
Figure 4:
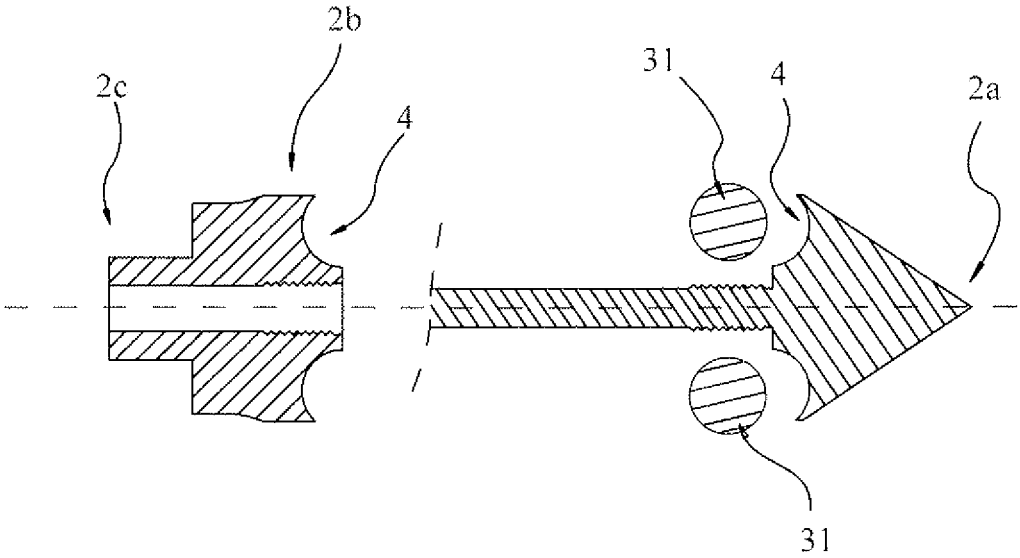
FIGS. 4 and 5 show a cross-sectional view of the arrowhead body according to two alternative assemblies of the second and third embodiments.
Figure 5:
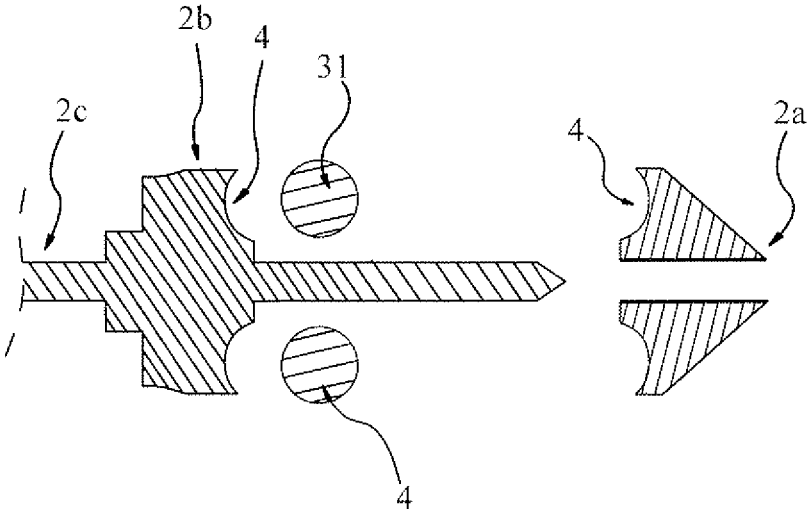
Figure 6:
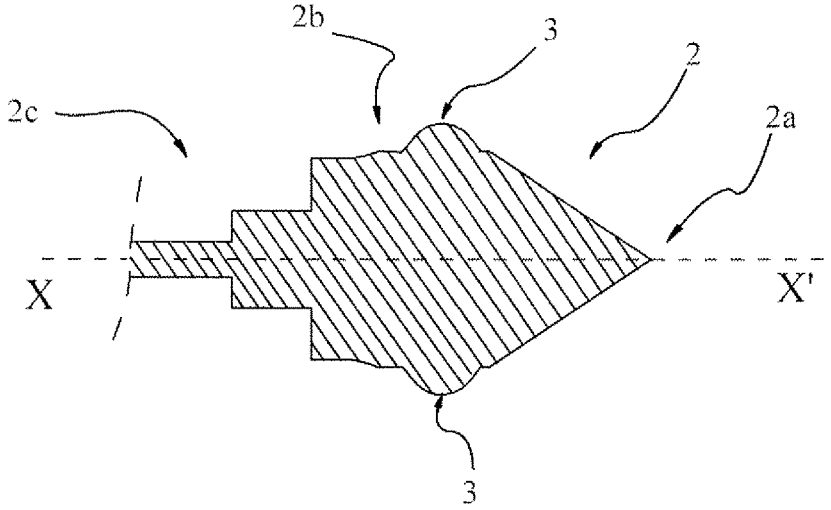
FIG. 6 shows a cross-sectional view of the arrowhead according to the first embodiment of the invention.

According to the first embodiment, illustrated by FIGS. 1*c* and 6, the projecting profile(s) (3) is/are one or more component(s) of the arrowhead body, specifically of the central portion (2*b*). The projecting profile(s) is/are therefore integral with the arrowhead body and thus constitute a single piece. The profile(s) (3) is/are therefore made from the block by milling or casting, or any other methods for its manufacture.

According to a second embodiment, illustrated by FIGS. 1*a*, 2, 3*a*, 3*b*, 4 and 5, the projecting profile(s) (3) is/are formed by at least one bearing ball (31).

The bearing ball(s) (31) is/are arranged in at least one groove (4) forming at least one hollow profile, and comprise (s) a portion (3) projecting beyond the outer peripheral surface of the arrowhead body.

As the hollow housing formed by the groove (4) opens out to the peripheral outside of the arrowhead, the bearing ball(s) (31) inserted in the housing (4) has/have an outward free portion. This outward free portion is actually adapted to be in contact with the target (101) once the arrow (100) is inserted.

In other words, the profile of the hollow housing (4) has a height less than the diameter of the bearing ball(s) (31), The fact that the bearing ball(s) (31) form(s) at least one peripheral projection (3) performs two actions. In the first action, which occurs during penetration into the target (101), the projecting bearing ball(s) space the material apart and prevent the arrowhead body (101) from sticking to the target; and the second action is to facilitate the removal of the arrowhead using these rolling mechanisms.

Figure 7:
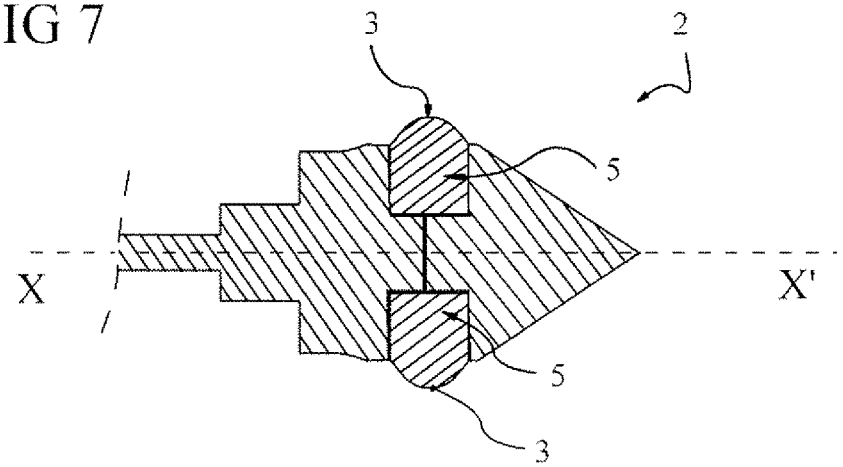
FIGS. 7 and 8 show a cross-sectional view of the arrowhead according to a plurality of alternative constructions of the third embodiment.
Figure 8:
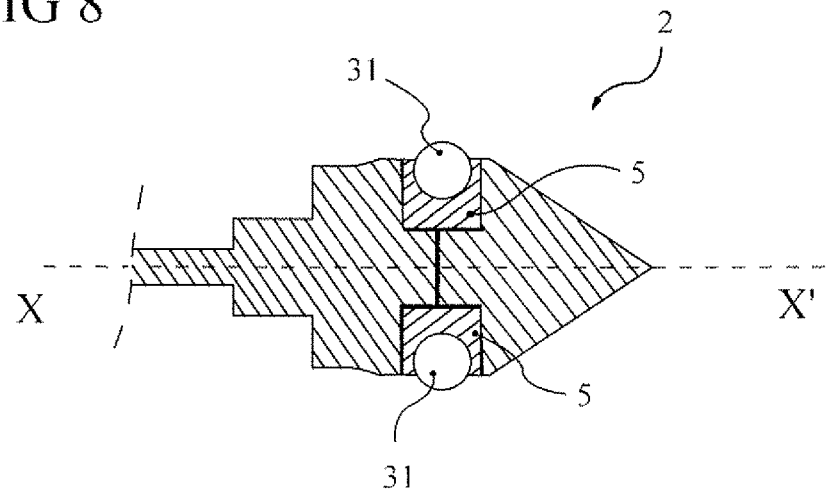

According to a third embodiment, illustrated by FIGS. 1*b*, 7 and 8, the mechanism(s) facilitating the extraction of the arrowhead body is/are formed by at least one annular ring (5) comprising the mechanisms facilitating the extraction of the arrowhead. This ring (5) is adapted to be positioned between two arrowhead body portions. It is thus clamped between two elements forming the arrowhead and made of a rigid, non-deformable material.

According to an alternative embodiment of the invention, the ring(s) (5) comprise(s) one or more projection(s) (3) oriented outward, made from the block, or adhered on its peripheral surface. According to another alternative, the ring(s) comprise(s) at least one opening in which at least one bearing ball (31) is inserted.

According to another alternative embodiment, the ring(s) is/are inserted in a peripheral groove.

According to another characteristic of the second and third embodiments of the invention, the arrowhead body is comprised of at least two separable portions (1*a*, 1*b*) enabling the insertion and retention of the bearing balls (31), on the one hand, and the insertion and retention of the ring (4) carrying the extraction facilitating mechanisms, on the other hand In the case of the bearing balls (31), the boundary separating the two portions is in the area of the hollow profile forming the groove (4). Indeed, this embodiment enables the bearing ball(s) to be inserted in the device.

The separable portions (1*a*, 1*b*) comprise blocking mechanisms in longitudinal position. These mechanisms are advantageously formed by corresponding threads and, according to other alternatives, by crimping, gluing, clipping, or wedging, According to yet another embodiment of the invention, the mechanisms facilitating the extraction of the arrowhead body are formed by at least one opening receiving at least one bearing ball (31). This/these opening(s) is/are advantageously formed on the peripheral surface of the arrowhead body and preferably on its central portion. Each opening receives one ball (31); however, according to other embodiments, each opening receives a plurality of balls (31).

According to a main characteristic of the invention, the bearing ball(s) is/are free in rotation and adjacent one another.

According to another main characteristic of the invention, the mechanisms for extracting of the arrowhead are made of a non-deformable material.

The invention claimed is:

1. An arrowhead that facilitates extraction from a target, said arrowhead comprising:

a front portion of a three-portion arrowhead body, said front portion including a pointed end for penetrating into the target;

a rear portion of the three-portion arrowhead body;

a central portion of the three-portion arrowhead body located between the front portion and the rear portion, said central portion comprising at least one extraction facilitating mechanism that facilitates extraction from the target of an arrow to which is mounted the arrowhead; and said at least one extraction facilitating mechanism comprising at least one partially spherical projecting profile.

2. The arrowhead of claim 1, wherein the at least one partially spherical projecting profile is fixed relative to a longitudinal axis of the three-portion arrowhead body.

3. The arrowhead of claim 1, wherein the at least one partially spherical projecting profile projects from an outer peripheral surface of the three-portion arrowhead body.

4. The arrowhead of claim 1, wherein the at least one partially spherical projecting profile comprises plural spaced apart partially spherical projecting profiles that project from an outer peripheral surface of the three-portion arrowhead body.

5. The arrowhead of claim 1, wherein the at least one partially spherical projecting profile comprises three spaced apart partially spherical projecting profiles that project from an outer peripheral surface of the three-portion arrowhead body.

6. The arrowhead of claim 1, wherein the at least one partially spherical projecting profile projects from an outer peripheral surface of the three-portion arrowhead body by less than 5.0 mm.

7. The arrowhead of claim 1, wherein the at least one partially spherical projecting profile projects from an outer circumferential peripheral surface of the three-portion arrowhead body.

8. The arrowhead of claim 1, wherein the at least one partially spherical projecting profile is arranged on a ball bearing.

9. The arrowhead of claim 1, wherein the at least one partially spherical projecting profile is arranged on a ball bearing that extends into at least one groove located in the central portion.

10. The arrowhead of claim 1, wherein the at least one partially spherical projecting profile is arranged a ball bearing that extends into at least one opening located in the central portion.

11. The arrowhead of claim 1, wherein the at least one partially spherical projecting profile is arranged on a freely rotatable ball bearing that extends into at least one groove located in the central portion.

12. The arrowhead of claim 1, wherein the at least one partially spherical projecting profile is arranged a freely rotatable ball bearing that extends into at least one opening located in the central portion.

13. The arrowhead of claim 1, wherein the at least one partially spherical projecting profile is arranged on a ring that is mounted to the central portion.

14. The arrowhead of claim 1, wherein the at least one partially spherical projecting profile is arranged on a ring that is mounted between separable sections of the three-portion arrowhead body.

15. The arrowhead of claim 1, wherein the at least one partially spherical projecting profile is arranged on a ring made of non-deformable material and that is mounted to the central portion.

16. The arrowhead of claim 1, wherein the at least one partially spherical projecting profile is arranged on a ring made of non-deformable material and that is mounted between separable sections of the three-portion arrowhead body.

17. The arrowhead of claim 1, wherein the central portion is integrally formed with the front and rear portions.

18. An arrowhead that facilitates extraction from a target, said arrowhead comprising:

a front portion that includes a pointed end for penetrating into the target;

a rear portion configured to mount the arrowhead to an arrow; and a central portion located between the front portion and the rear portion and comprising at least one outwardly curved projecting profile that projects from outer peripheral surfaces located on opposite sides of the least one outwardly curved projecting profile, wherein the at least one outwardly curved projecting profile is one of:

integrally formed with an outer cylindrical surface of the central portion;

arranged on a ring; and arranged on one of plural space apart ball bearings.

19. An arrowhead that facilitates extraction from a target, said arrowhead comprising:

a front portion including a pointed end for penetrating into the target;

a rear portion configured to mount the arrowhead to an arrow; and a central portion located between the front portion and the rear portion and comprising at least one outwardly curved projecting profile that projects from an outer peripheral surface, wherein the at least one outwardly curved projecting profile is arranged on one of:

an outer cylindrical surface of the central portion, with said central portion being integrally formed with the front and rear portions;

a ring located in a groove formed in separable portions of the three-portion arrowhead body; and one of plural space apart ball bearing arranged in openings formed in separable portions of the three-portion arrowhead body.

* * * * *